US005884716A

United States Patent [19]

Beasley

[11] Patent Number: 5,884,716

[45] Date of Patent: Mar. 23, 1999

[54] CONSTANT BOTTOM CONTACT THRUSTER

[75] Inventor: Thomas R. Beasley, Katy, Tex.

[73] Assignee: Dailey Petroleum, Conroe, Tex.

[21] Appl. No.: 731,550

[22] Filed: Oct. 16, 1996

[51] Int. Cl.[6] ..... E21B 17/07

[52] U.S. Cl. ..... 175/321; 175/324

[58] Field of Search ..... 175/321, 324, 175/317, 27, 234, 232

[56] References Cited

U.S. PATENT DOCUMENTS

| | | | |
|---|---|---|---|
| 1,662,358 | 3/1928 | Bozeman et al. | 175/321 |
| 1,766,326 | 6/1930 | Bozeman et al. | 175/321 |
| 1,891,329 | 12/1932 | Le Compte et al. | 175/27 |
| 2,684,835 | 7/1954 | Moore | 255/28 |
| 2,756,723 | 7/1956 | Bassinger | 175/321 |
| 3,223,183 | 12/1965 | Varney | 175/27 |
| 3,303,894 | 2/1967 | Varney | 175/321 |
| 3,410,355 | 11/1968 | Garrett | 175/317 |
| 3,463,252 | 8/1969 | Miller et al. | 175/321 |
| 4,212,359 | 7/1980 | Adcock | 175/26 |
| 4,270,620 | 6/1981 | Lawrence | 175/322 |
| 4,434,863 | 3/1984 | Garrett | 175/321 |
| 4,446,922 | 5/1984 | Bowyer et al. | 166/322 |
| 4,660,656 | 4/1987 | Warren et al. | 175/26 |
| 4,844,180 | 7/1989 | Zijsling | 175/107 |
| 4,901,806 | 2/1990 | Forrest | 175/321 |
| 5,101,904 | 4/1992 | Gilbert | 166/319 |
| 5,105,890 | 4/1992 | Duguid et al. | 166/380 |
| 5,205,364 | 4/1993 | Juergens et al. | 175/38 |
| 5,205,365 | 4/1993 | Quintana | 175/97 |
| 5,311,954 | 5/1994 | Quintana | 175/61 |
| 5,316,094 | 5/1994 | Pringle | 175/74 |
| 5,394,951 | 3/1995 | Pringle et al. | 175/61 |
| 5,421,420 | 6/1995 | Malone et al. | 175/61 |

FOREIGN PATENT DOCUMENTS

| | | |
|---|---|---|
| 536 490A | 5/1955 | Belgium . |
| 0 288 123A | 10/1988 | European Pat. Off. . |
| 0 624 709 A | 11/1994 | European Pat. Off. . |
| 96 38653 A | 12/1996 | WIPO . |

OTHER PUBLICATIONS

Article Entitled "Drilling bumper subs improve deviated well economics," *Technology At Work*, Reprinted from Feb. 1995 *World Oil*®.

Baker Hughes Technical Data Sheet Article Entitled "Slim-hole Thruster".

*Primary Examiner*—Hoang C. Dang

*Attorney, Agent, or Firm*—Arnold White & Durkee

[57] ABSTRACT

The present invention is an improved apparatus for controlling the weight on the drill bit during operation. In this invention, an inner mandrel has a telescoping movement in response to added drill string length at the surface. As the inner mandrel telescopes closed, it approaches a restrictor which is fixedly disposed in the lower housing of the drill string assembly. When the inner mandrel mates with the restrictor, a stand-pipe pressure increase noticeable to the operator occurs. The operator then stops the drill string and allows the motor to drill ahead. As the motor drills ahead, the inner mandrel telescopes open and the operation is then repeated.

5 Claims, 2 Drawing Sheets

CONSTANT BOTTOM CONTACT THRUSTER

BACKGROUND OF THE INVENTION

1. Field of the Invention

This invention relates to a downhole drilling mechanism that controls the weight and torque applied to a drill bit during operation. More specifically, this invention relates to a constant bottom contact thruster used in a drill string to advance the drill string in pre-selected increments and, therefore, control the weight applied to the drill bit during operation and thus, prevent stalling of the drilling motor.

2. Background

In order to obtain optimum penetration rates, oil and gas operators desire to control the weight on the drilling bit during drilling operations. If excessive weight is placed on the tool, excessive wear and breakage of the tool can occur or the drilling motor will stall.

For most drilling tools, there is an optimum total weight, or a range between a minimum and maximum weight to have on the bit during downhole drilling. However, during actual operations, changes in working pressures and formations, and working in deeper holes can make it difficult to control the weight applied to the tool. Also, when performing horizontal drilling, the drag friction becomes much greater than the dynamic friction. This is particularly true in horizontal drilling utilizing a downhole motor. When using a downhole motor, the drill string does not rotate, but rather primarily functions to guide the downhole motor. Therefore, during such operations, the drill string merely "slides" inside the borehole. Thus, significant static friction acts against the drill string as additional sections of drill string are added. In order to overcome the static pressure acting against the drill string, the operator must provide excess weight on the drill string. When the drill string overcomes the static friction and begins to move, the excess weight must be quickly removed from the drill string or it will cause excess weight on the drill bit, thus, causing the downhole motor to stall. It is difficult for even the most experienced operator to avoid overloading the tool and, at a minimum, it is a very time consuming and fatiguing task.

Prior art methods of controlling the weight on the drill bit include preloading the tool with a telescoping fixture interconnecting the preload drill pipe and drill string so that a constant load is maintained on the tool. However, with such a system, the operator must be able to calculate the accurate preload required. Bumper subs are also used to control weight on drill bits. A bumper sub can be compared to a conventional hydraulic cylinder, similar to those used on construction equipment. The hydraulic pressure in a sub is generated by drill bit differential pressure which is a function of drilling fluid properties, flowrate and bit nozzle size selection. The hydraulic pressure in the sub causes an extension force, or pump open force, to occur. The extension force causes the bumper sub to extend open and thereby exert pressure on the drill bit.

It would be desirable to develop a drill string having a part which allows the operator to control the weight on the drill bit without binding or stalling the downhole motor.

SUMMARY OF THE INVENTION

The present invention overcomes some of the deficiencies of the prior art by providing an apparatus in the housing of a drill string assembly that allows the operator to better control the weight on the bit. The invention consists of a restrictor disposed inside a lower portion of a drill string housing and an inner mandrel adapted to mate with the restrictor. In response to an increase in drill string length from the surface, the inner drill string mandrel has a telescoping movement that causes the inner mandrel to mate with the restrictor and thereby signals a pressure increase to the operator. The signal enables the operator to set the brake and allow the drill bit to drill ahead. Additionally, the diameters of certain portions of the drill string housing can be varied to increase the pump operating force on the bit for difficult formations and drilling conditions.

Figure 1:
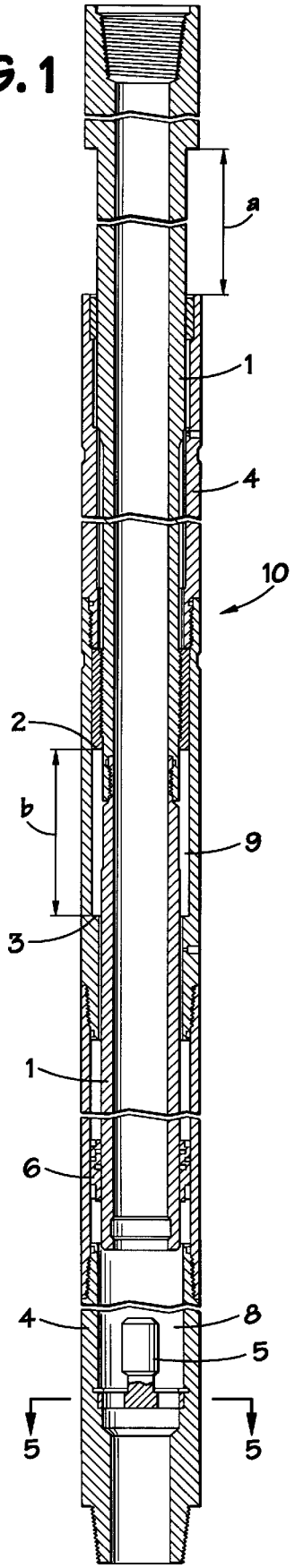
FIG. 1 is a cross-sectional view of the invention showing the inner mandrel in the open position.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives following within the spirit and scope of the invention as defined by the appended claims.

DETAILED DESCRIPTION OF THE INVENTION

A downhole drilling tool is generally depicted by the numeral 10 in FIGS. 1, 2, 3 and 4. The downhole drilling tool 10 is generally comprised of housings 4, inner mandrels 1, floaters 6, and restrictor 5. In operation, high pressure drilling fluid 8 is circulated inside the inner mandrels 1 and through restrictor 5. Oil 9 is contained between floater 6, a ring portion 20, the outer diameter of inner mandrel 1 and the inner diameter of housing 4. As show in FIG. 3, the oil is thus contained within a first annular chamber 30. A second annular chamber 40 is defined by floater 6, the inner diameter of the outer housing 4, the outer diameter of an intermediate sleeve 50, and an annular shoulder 60 located on the inner diameter of housing 4. A port 70 provides communication between the inner bore of the single assembly inner drill string mandrel 1 and second annular chamber 40. The high pressure from the circulation of drilling fluid 8 inside inner mandrel 1 is communicated through port 70 to the second annular chamber 40 creating high pressure in second annular chamber 40. Also, in the alternate embodiment (FIGS. 3 and 4), low pressure drilling fluid 11 is circulated from the drilling hole into a portion of the area between the outer diameter of inner mandrel 1 and inner diameter of housing 4. These two diameters, in conjunction with an end sleeve 80 and an annular shoulder 65 form a low pressure drilling fluid chamber.

Referring now to FIG. 1, the present invention includes one primary moving assembly, the inner drill string mandrel 1. The inner drill string mandrel 1 includes a drill string component 90, ring portion 20, intermediate sleeve 50, and an end sleeve 100. The ring portion 20 is coupled to the outer diameter of the inner drill string mandrel 1. The inner drill string mandrel's components are coupled together, and act as a single assembly, moving jointly in slidable relation to the outer housing 4. The inside diameter of these components defines a continuous inner bore through which the drilling fluid can be circulated. The inner drill string mandrel ("inner mandrel") moves in a telescoping manner in response to an increase in drill string length. In other words, as the operator adds one or more drill strings on the operating platform, the inner mandrel moves in a telescoping fashion towards the drill bit. The amount of allowable travel of the inner mandrel is determined by the dimension denoted by the letter a. In the preferred embodiment, the a dimension, or total allowable travel distance, is 15 inches.

The total allowable travel distance of the inner mandrel is also shown by the dimension denoted by the letter b. Typically, and in the preferred embodiment, the dimensions a and b are equal. The b dimension is also referred to as the "hammer." When the inner mandrel is in its most retracted movement, a "hammer action" occurs when a portion 2 of the inner mandrel meets or hits against shoulder 3 of the housing 4.

It is preferred during operation that the hammer action not actually occur, or at least, the hammer action force is very minimal. Rather, it is preferred during operation that the operator set the brake to stop the drill string from the platform just prior to the hammer action occurring. By braking just prior to the hammer action, the operator has better control of the weight on the bit and, therefore, is better able to prevent stalling of the drilling motor.

Figure 2:
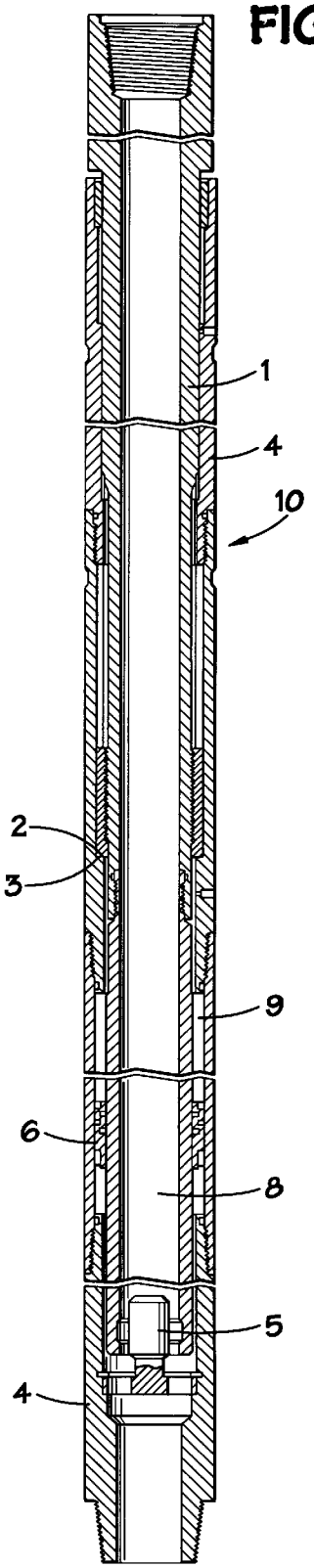
FIG. 2 is a cross-sectional view of the invention showing the inner mandrel in a closed position, i.e., mating with the restrictor.

During drilling operations using the present invention, the rig operator is able to determine when the inner mandrel approaches its full stroke (or hammer action) through use of the restrictor 5, also known as a tell-tale. The rig operator is able to determine that the inner mandrel is near full stroke by means of a pressure increase in the drilling fluid. A pressure increase in the drilling fluid can be typically determined by means of a pressure gauge on the drilling rig. An increase in the drilling fluid pressure is caused as the inner mandrel approaches the restrictor 5 due to the pressure drop across the restriction in flow between the mated or near mated connection between the inner mandrel 1 and restrictor 5. If the inner mandrel 1 is allowed to reach its full stroke length, the inner mandrel will be in its closed position as shown in FIG. 2 and a sharp pressure increase will occur due to the mating of the inner mandrel 1 and restrictor 5.

When the inner mandrel reaches the full stroke, or open position, the downhole drilling motor will stop drilling, creating a noticeable stand-pipe pressure drop due to the reduction of motor torque. Once the open position is reached, the operator releases the brake and the stroke operation is repeated. The most efficient drilling is continuous drilling. Therefore, the operator preferably should note the time to drill the full stroke length of the inner mandrel 1 and brake just prior to the end of the stroke to let the down hole motor drill bit drill ahead in a continuous fashion. The invention can be adjusted in the field by selecting different sized restrictors 5 that are needed for different specific flow rates for the drilling fluids. Also, the restrictors 5 can be in different shapes. However, the preferred shape of restrictor 5 is a generally cylindrical shape.

The weight on the bit applied by the inner mandrel can also be adjusted by varying the flow rate, the bit flow area and the type of positive displacement motor used. In a preferred embodiment, the invention has the following specifications:

| | |
|---|---|
| Outside Diameter (In.) | 4¾ |
| Tool Joint Size (API) | 3½ IF |
| Inside Diameter (In.) | 2¼ |
| Tensile Yield (Lbs.) | 500,000 |
| Torsianal Yield (Ft. Lb.) | 20,000 |
| Maximum Overpull (Lbs.) | 85,000 |
| Maximum Circulating Pressure (PSI) | 5,000 |
| Maximum Hydrostatic Pressure (PSI) | None |
| Housing Torque at Assembly (Ft. Lbs.) | 14,000 |
| Total Travel (In.) | 15 |
| Approximate Length Closed (In.) | 142 |
| Approximate Weight (Lbs.) | 475 |
| Maximum BHI (°F.) | 400 |
| Pump Open Area (Sq. In.) | 10.3 |

Figure 5:
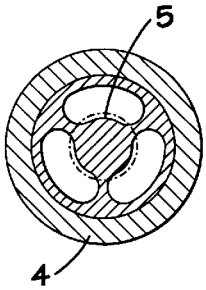
FIG. 5 is a cross-sectional view of the preferred embodiment of the restrictor 5.
Figure 4:
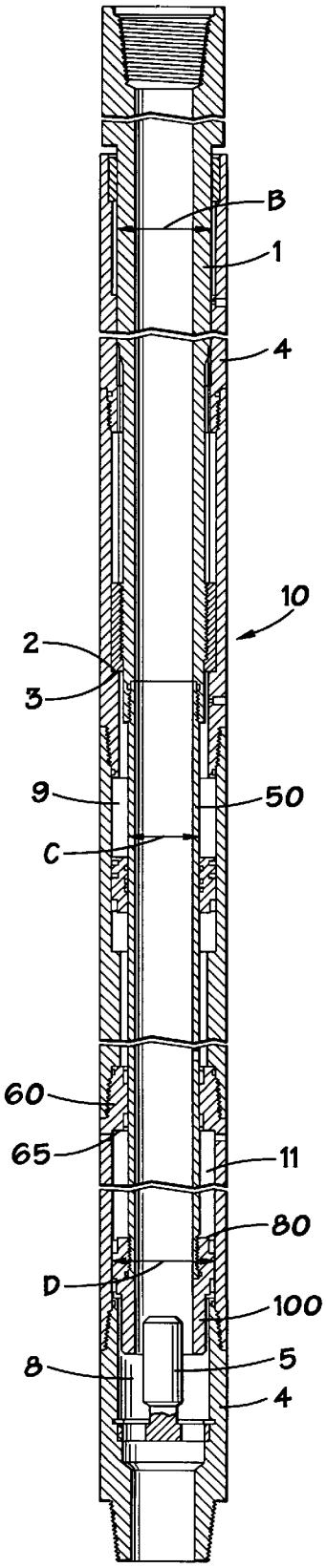
FIG. 4 is a cross-sectional view of the embodiment of FIG. 3 in which the inner mandrel is in a closed position, i.e., the inner mandrel is mated with the restrictor.

The restrictor 5 preferably has a cross-sectional as shown in FIG. 5. However, it will be appreciated that the restrictor can be of various shapes and sizes and remain within the scope of the invention. In addition, to take full advantage of the pump open force generated by the invention, the inner mandrel 1 and restrictor 5 should be placed as close to the drill bit as possible. When drilling with a positive displacement motor, the inner mandrel 1 and restrictor 5 are preferably placed directly above the motor.

Figure 3:
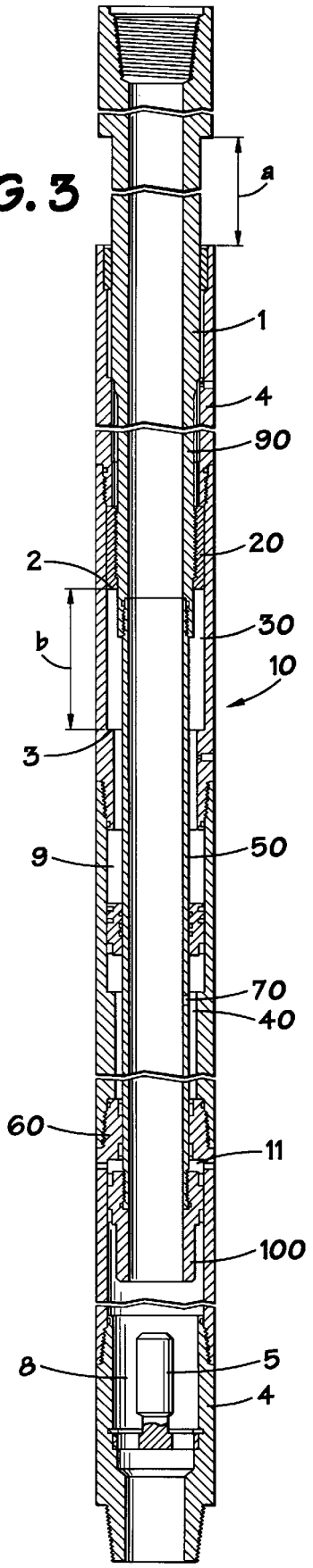
FIG. 3 is a cross-sectional view of another embodiment of the invention in the open position and showing the location of varying inner string diameters that cause an increased pump operating force.

In another embodiment of the invention (shown in FIGS. 3 and 4), various diameters of the drill string housing and inner mandrel are changed to cause an increased pump open force. The diameters that are adjusted are shown in FIG. 3 as diameters B, C and D. It will be appreciated by those with skill in the art that Pump Open Force (POF) is equal to a change in pressure multiplied by the area ($POF=\Delta P\times A$). It will also be appreciated that $A=\pi/4(D^2+(B^2-C^2))$. Thus, it is desirable to make the change in diameter between B and C as great as possible. The specifications for this embodiment typically are:

| | |
|---|---|
| Outside Diameter (In.) | 4¾ |
| Tool Joint Size (API) | 3½ IF |
| Inside Diameter (In.) | 2¼ |
| Tensile Yield (Lbs) | 500,000 |
| Torsianal Yield (Ft. Lb.) | 20,000 |
| Maximum Overpull (Lbs.) | 85,000 |
| Maximum Circulating Pressure (PSI) | 5,000 |
| Maximum Hydrostatic Pressure (PSI) | None |
| Housing Torque at Assembly (Ft. Lbs.) | 14,000 |
| Total Travel (In.) | 15 |
| Approximate Length Closed (In.) | 177 |
| Approximate Weight (Lbs.) | 590 |
| Maximum BHI (°F.) | 400 |
| Pump Open Area (Sq. In.) | 16.4 |

It will be appreciated that this embodiment works in the same manner as the preferred embodiment, except that the varied diameters cause an increased pump open force for use in formations where additional weight on the bit is required. Typically, the diameters are as follows: B=3.625 in., C=2.875 in. and D=4.000 in. However, it will be appreciated by those with skill in the art that it is the difference between $B^2$ and $C^2$ added to $D^2$ that increase the area. Thus, maximizing these dimensions such that they maximize area increases the pump open force. It will also be appreciated that the pertinent diameters correspond to the following parts of the drill string assembly: B is the outer diameter of the upper end of the inner mandrel, C is the outer diameter of the inner mandrel proximate the lower end of the inner mandrel; and D is the inner diameter of the lower housing proximate the restrictor.

What is claimed is:

1. A thruster for advancing a drill string in controlled increments, comprising:

an outer housing having a first and second end, an inner diameter and an outer diameter, and a plurality of annular shoulders along said inner diameter;

a single assembly inner drill string mandrel defining a continuous inner bore for circulating high pressure drilling fluid, the single assembly inner drill string mandrel being in slidable contact with the outer housing and comprising a drill string component, an intermediate sleeve, and an end sleeve, wherein the drill string component has an outer diameter, and has a first end releasably connectable to a drill string and a second end fixedly attached to a first end of the intermediate sleeve, and the intermediate sleeve has an outer diameter and a second end fixedly attached to the end sleeve;

a ring portion fixedly attached to the outer diameter of the single assembly inner drill string mandrel;

a floater disposed in sealable contact between the inner diameter of the outer housing and the outer diameter of the intermediate sleeve;

a first annular chamber defined by a first end of the floater, the inner diameter of the outer housing, the outer diameter of the drill string component and the outer diameter of the intermediate sleeve, and the first end of the outer housing;

a port through the intermediate sleeve, the port communicating between the continuous inner bore and a second annular chamber defined by a second end of the floater, the inner diameter of the outer housing, the outer diameter of the intermediate sleeve, and a first end of a first shoulder of said plurality of annular shoulders;

a low pressure drilling fluid chamber in communication with a low pressure drilling fluid, the low pressure drilling fluid chamber defined by a first end of the end sleeve, the inner diameter of the outer housing, the outer diameter of the intermediate sleeve, and a second end of the first shoulder; and a restrictor secured within the second end of the outer housing, axially aligned with the continuous inner bore.

2. The thruster of claim 1 wherein a second shoulder of said plurality of annular shoulders defines a first endpoint for the slidable movement of the single assembly inner drill string mandrel, and a third shoulder of said plurality of annular shoulders defines a second endpoint for the slidable movement of the single assembly inner drill string mandrel.

3. The thruster of claim 1 wherein the ring portion is fixedly attached to the outer diameter of the drill string component.

4. The thruster of claim 1 wherein the outer diameter of the drill string component is greater than the outer diameter of the intermediate sleeve.

5. The thruster of claim 3 wherein the first annular chamber contains an oil, the second annular chamber contains high pressure drilling fluid, and the low pressure drilling fluid chamber contains low pressure drilling fluid.

* * * * *